US005758872A

United States Patent [19]

Seidel et al.

[11] Patent Number: 5,758,872

[45] Date of Patent: Jun. 2, 1998

[54] BUNDLING AND STRAPPING DEVICES AND METHODS

[75] Inventors: Randy R. Seidel; Harry Noll, both of Allentown, Pa.; Richard Merwarth, Bay Village, Ohio

[73] Assignee: Graphic Management Associates, Inc., Del.

[21] Appl. No.: 734,970

[22] Filed: Oct. 23, 1996

[51] Int. Cl.[6] ..... B65H 39/02

[52] U.S. Cl. ..... 270/58.11; 270/58.34

[58] Field of Search ..... 270/58.01, 58.07, 270/58.08, 58.11, 60, 58.34

[56] References Cited

U.S. PATENT DOCUMENTS

| | | | |
|---|---|---|---|
| 768,461 | 8/1904 | Juengst | 270/58.34 X |
| 3,809,384 | 5/1974 | Zugel | 270/52.28 |
| 4,772,003 | 9/1988 | Nobuta et al. | 270/58.34 X |
| 4,917,365 | 4/1990 | Stemmler et al. | 270/58.34 |
| 5,326,088 | 7/1994 | Newsome | 270/52.3 X |
| 5,551,682 | 9/1996 | Luthi | 270/52.3 X |

*Primary Examiner*—Hoang Nguyen

*Attorney, Agent, or Firm*—Jordan B. Bierman; Bierman, Muserlian and Lucas

[57] ABSTRACT

A device and method for forming stacks of planar elements, particularly newspapers, wherein the elements are serially discharged onto a receiver, compressed to eliminate entrapped air, and bound with fusible tape. The stacks are bound by providing tape which extends across the path through which the individual stacks travel. As the stacks move down the path, they press against the tape, causing it to be discharged from sources thereof and to wrap itself around three sides of the stack. Welding heads are then moved in from the sides to press the tape together and fuse it into two portions. One portion is wrapped around the stack and the other constitutes the tape which will be contacted by the next stack in the cycle.

31 Claims, 4 Drawing Sheets

BUNDLING AND STRAPPING DEVICES AND METHODS

The present Invention is directed to devices and methods for bundling and strapping of planar elements. More specifically, it is primarily intended for use in connection with newspapers, especially those which are flexible and non self supporting in the vertical position. Although the Invention is of broader application, for convenience it will be described in terms of the bundling and strapping of stacks of newspapers.

BACKGROUND OF THE INVENTION

Strapping devices are intended to wrap thin flexible tape around a plurality of newspapers and fuse the ends in order to form a bundle. In the past, such tapes have been fed through feed channels on either side of the path of the bundle, wrapped therearound, and the ends fused. However, these devices suffered from a number of defects.

In particular, the tapes were pushed through the feed channels; thus, any impediment to the passage of tape would prevent proper feeding and result in a failure of the device to properly secure the papers. Thus, it was necessary to keep the channels perfectly clean and smooth. To minimize this problem, thicker tapes were used in an effort to provide additional stiffness so that the tapes would be less sensitive to irregularities within the feed channel. However, these expedients were not fully successful.

Furthermore, as newspapers are placed in a stack, they tend to bulge because of air entrapped between the various pages thereof. In particular, the folded edge tends to be greater in thickness than the remainder of the paper. As a result, unless the orientation of the papers is alternated, one side of the stack becomes higher than the other and at least some of the papers tend to slide off.

SUMMARY OF THE INVENTION

Therefore, it is among the objects of the present Invention to provide a device and method which will function smoothly, even if the feed channels are not clean and have become roughened. It is further among the objects of the present Invention to provide suitable compression on the stacks so that they are maintained substantially level, even without reversing the orientation thereof. It is still further among the objects of the present Invention to provide a bundling and strapping device, and method for the use thereof, which is capable of receiving newspapers directly from existing inserters and conveyors.

In accordance with the present Invention, there is provided a receiver for a plurality of newspapers which are deposited successively thereon to form an initial stack. Preferably, the receiver moves along a path in a downstream direction so that the top of the stack being built is always at the same level. Thereafter, the receiver moves laterally out of the path, allowing the stack to be transferred to a compressor. A retainer is then introduced into the path upstream of the stack and the compressor moves toward the retainer, thereby exerting compressive force on the stack. In a desirable form of the device, a pressure sensor is located on or in the stack and, when the pressure reaches a predetermined level, compression is brought to an end. The compressor then moves out of the path, thereby discharging the stack. Successive stacks are treated in the same way and, advantageously, a plurality of receivers and a plurality of compressors are provided in order to increase the number of stacks which the device can handle in a given period of time.

In addition to the foregoing, it has been found useful to provide one or more fingers which are adapted to exert precompression on the folded edge of the newspapers. This is accomplished as the stack is being built and serves to prevent or minimize the unevenness inherent in the folded edge being thicker than the trailing edge.

When the stack is being formed directly from a gripper conveyor, a belt conveyor is provided in association therewith. As the papers are released by the grippers, they are allowed to drop onto the belt conveyor which urges them in the direction of the receiver. When the stack is at or near completion, it is necessary to start the formation of the next stack. To accomplish this, a separator, reciprocatable between a position remote from the stack and conveyors and a position adjacent the stack and conveyors, is used. As the separator moves into its adjacent position, it can then receive the papers being released by the grippers. However, in order to provide sufficient time for the separator to move into that position, the gripper conveyor is controlled so that the grippers, during the building of the stack, release the papers at a first point and, as the separator is moving to its adjacent position, release the papers at a second point. As the grippers travel, the second point is downstream of the first point. Therefore, there is a brief period of time wherein no papers are being released by the gripper conveyor. This allows the separator to move into position and begin the formation of the successive stack. Once the separator has reached its adjacent position, the gripper conveyor can release the papers at the first point once again.

The binding device of the present Invention consists of two sources of fusible, flexible, elongated tape and a corresponding pair of welding heads. The latter are movable between a retracted position, wherein they are spaced apart from each other, and a fusing position, wherein they abut each other with a portion of the tape therebetween. At least one of the heads includes a heater for fusing the tape. One source of tape, preferably a reel, is located on either side of the path followed by the stack. The tapes extend across the path and are fused between the two sources.

As the bundle moves along the path, it presses against the tape and pulls it out of the two sources. Due to this affirmative action, there is no problem with regard to the tape jamming or being impeded by roughness or uncleanliness of the feed channels. Moreover, in a preferred form of the device, the reels are biased so as to maintain tension on the tapes, thereby causing them to encircle the stack closely.

During this time, the welding heads are in their retracted position and, as the tapes are drawn out of the sources, they pass over the proximal surfaces of the retracted welding heads. After the stack has passed the heads, they move toward one another into their fusing position wherein the proximal surfaces of the heads abut one another with the tapes therebetween. This pulls the tape tightly around the bundle and the heating unit then fuses the tape together at two points. One point is immediately adjacent the upper end of the stack and the other is separated therefrom in the upstream direction. As a result, the portion of the tape around the stack is fused in place and the remaining tape is stretched across the path and fused, ready for the next stack.

BRIEF DESCRIPTION OF THE DRAWINGS

In the accompanying drawings, constituting a part hereof and in which like reference characters indicate like parts.

DETAILED DESCRIPTION OF THE INVENTION

Figure 2:
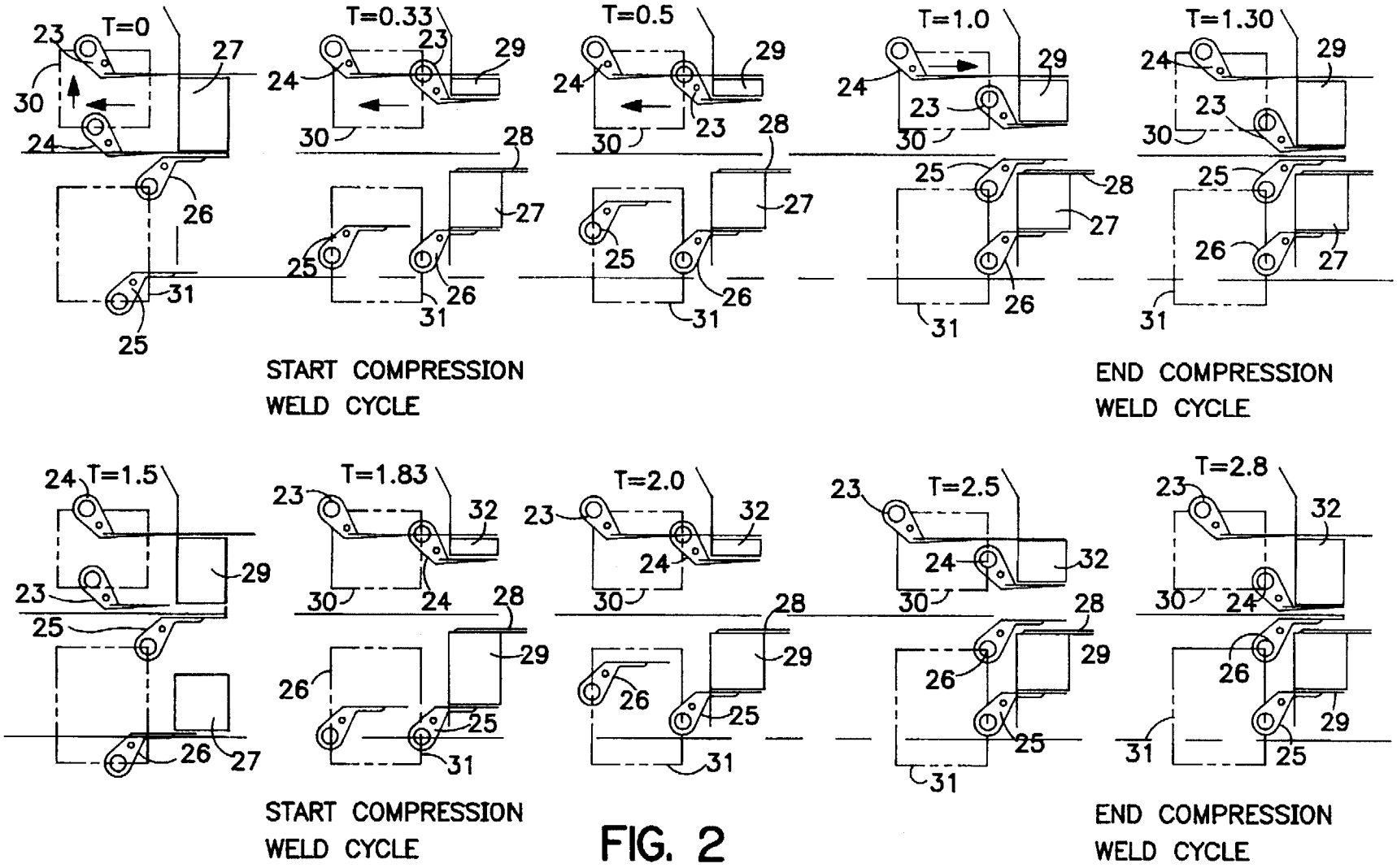
FIG. 2 is a schematic view showing two cycles wherein the stack is formed and compressed.

The operation of the stacker and compressor is shown in FIG. 2. Two cycles are depicted, the first from left to right in the upper portion of the Figure and the second similarly shown in the lower portion. The device comprises transporting forks 23 and 24, compression forks 25 and 26, and gate 28. At the upper left of FIG. 2, bundle 27 has been formed on transporting fork 24, but has not yet been compressed. In the next step, transporting fork 24 has moved out of the path of bundle 27 as shown by the arrows in transporting path 30. The bundle has been transferred to compressor 26 which has moved downward as shown in the adjacent figure. At the same time, transporting fork 23 has moved into position to receive the individual papers which will make up bundle 29.

Meanwhile, gate 28 has moved into position immediately above bundle 27 and compressor 26 now moves toward gate 28, thereby compressing bundle 27 therebetween. At the end of the compression cycle (the far right of the upper portion of FIG. 2), bundle 29 on transporting fork 23 has been completed. Compressor 25 is in position to receive bundle 29 when transporting fork 23 moves out of position as shown at the lower left of FIG. 2. Compressor 26 now moves down and to the left along compression path 31 in order to discharge completed and compressed bundle 27.

Thereafter, gate 28 moves into position above bundle 29 and compressor 25 moves upwardly to compress bundle 29 in the same way that compressor 26 compressed bundle 27. The remaining steps are the same as those on the upper portion of FIG. 2, except that a third bundle 32 is being formed and bundle 29 will be discharged. The cycle is, of course, repeated as often as desired.

Figure 3:
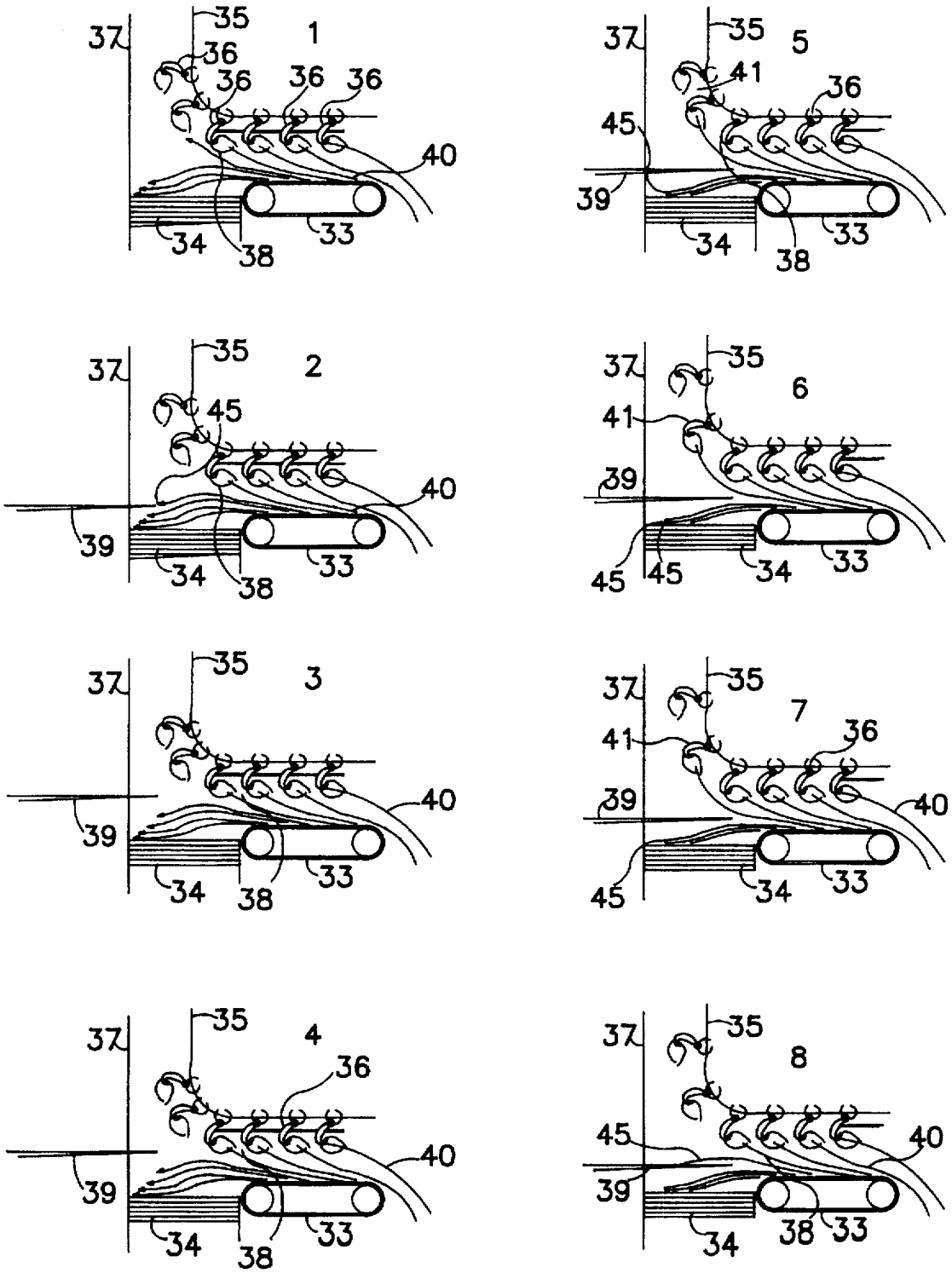
FIG. 3 is a schematic view showing a complete cycle wherein the stacker receives newspapers from the gripper conveyor and belt conveyor.

In FIG. 3, belt conveyor 33 receives papers 40 from gripper conveyor 35 carrying grippers 36. The upper flight of belt conveyor 33 moves to the left as shown in FIG. 3 and thus urges papers 40 against wall 37 as stack 34 is built thereby. During this stage of operation, gripper conveyor 35 releases papers 40 at drop point 38. Separator 39, as stack 34 is being completed, moves toward conveyors 33 and 35. As it does so, gripper conveyor 35 releases papers 40 at delayed drop point 41 (see the last three steps on the right side of FIG. 3). This allows separator 39 to move fully into its operative position and receive papers 40 to begin to build the next stack. Separator 39 then moves downwardly as the next stack is built in a manner analogous to the formation of stack 34. It is, of course, desirable to have a plurality of separators which are adapted to move into operative position synchronously with the completion of one stack and the beginning of another.

Figure 4:
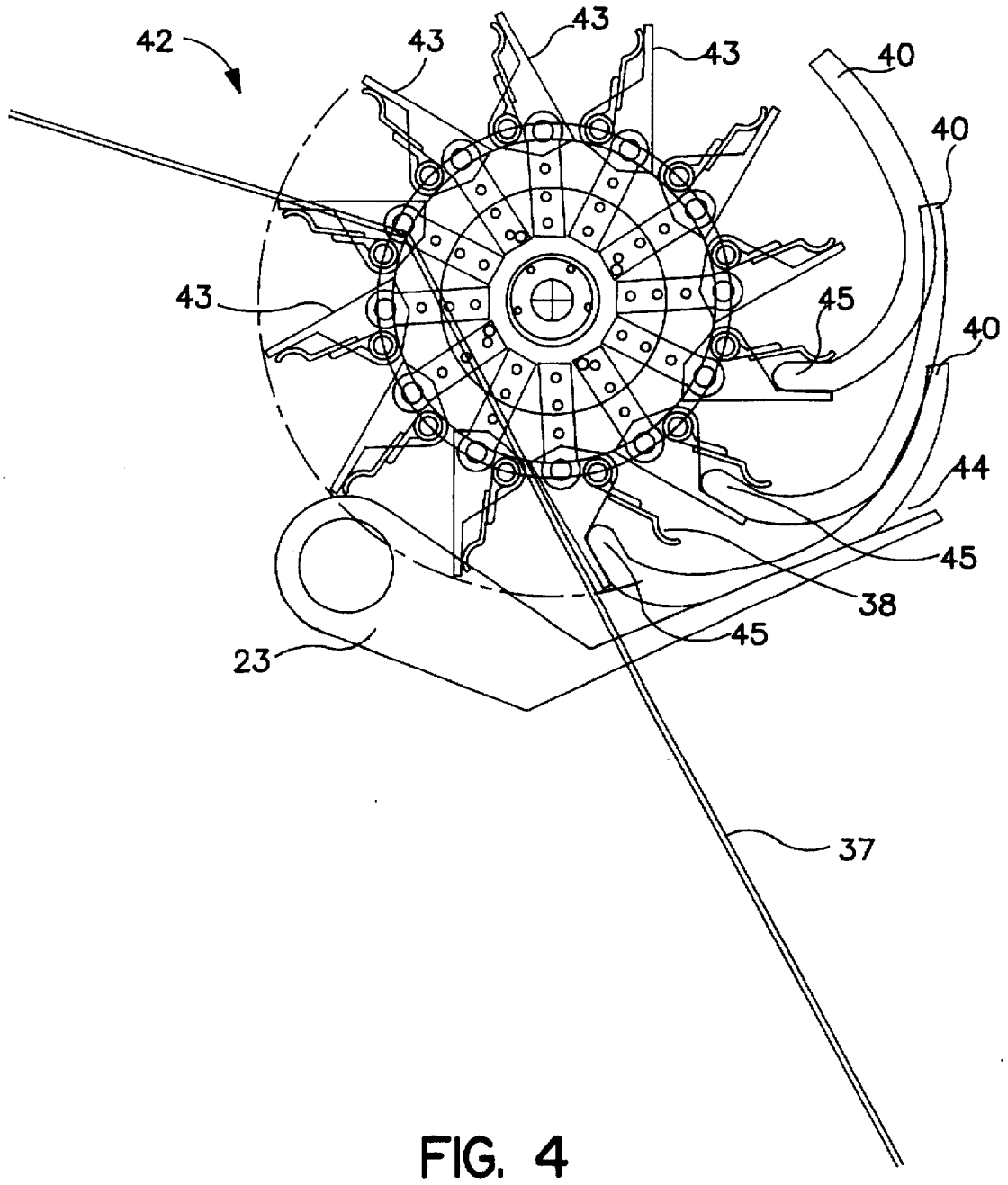
FIG. 4 is a schematic view, with parts omitted for clarity, showing the combination of the stacker and an inserter.

If the stacker is to receive papers from a transfer wheel (such as is often used in inserters), the construction is shown schematically in FIG. 4. Transfer wheel 42 rotates clockwise and carries grippers 43. Newspapers 40 are released serially at release point 38. Adjacent thereto is receiver 23, separated from wheel 42 by gap 44. Grippers 43 hold papers 40 by folded edge 45. This enables papers 40 to be deposited on receiver 23 in proper orientation so that folded edge 45 rests against wall 37. If gap 44 is large, certain problems arise. Since papers 40 are transferred from wheel 42 to receiver 23 by gravity, the speed at which they fall is determined, not by the speed of the device, but rather by the acceleration of gravity. The latter is, of course, a constant and cannot be changed. Therefore, if gap 44 is large, the time necessary for papers 40 to fall onto receiver 23 can limit the speed at which the device can operate. As the stacks of FIGS. 3 and 4 are formed, they are handled in accordance with FIGS. 1 and 2 to ultimately produce individual bundles bound by tape.

Figure 1:
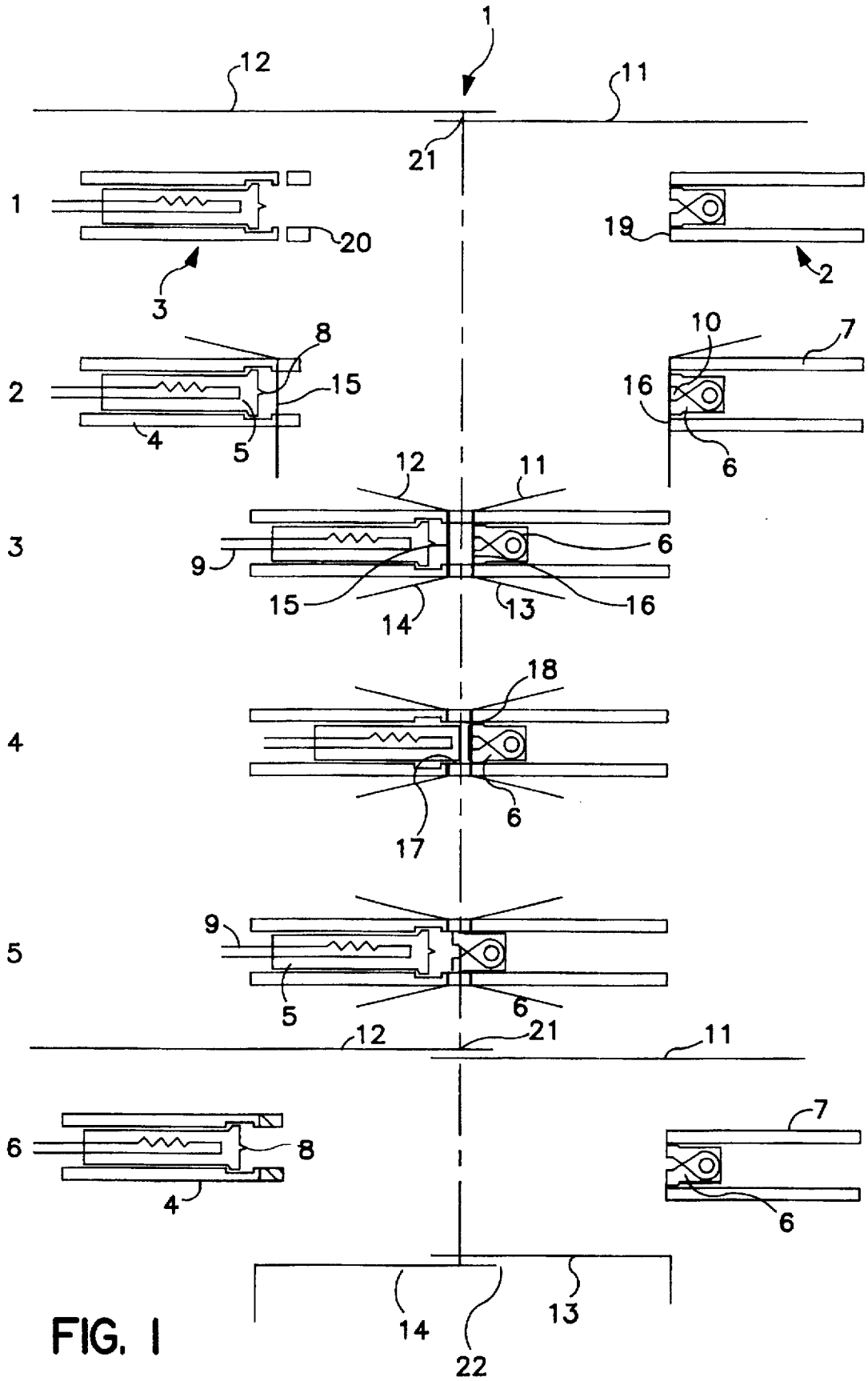
FIG. 1 is a schematic view showing a complete cycle of the binder.

The binder is shown schematically in FIG. 1. The stacks (not shown) are serially introduced along path 1 as indicated by the arrow. Upper lengths 11 and 12 of the tapes extend across path 1 and are joined at fuse point 21. Welding heads 2 and 3 are in their retracted positions. They consist essentially of hollow tubes 4 and 7, one containing heated unit 5 and the other provided with anvil 6. Heated unit 5 carries severing point 8 which is complementary to space 10 on the other welding head.

As a stack moves down path 1, it encounters upper lengths 11 and 12. The movement of the stack pulls the tapes out of their respective sources (not shown) so that they surround the leading face and two perpendicular sides of the stack. At the same time, the tapes are brought into contact with proximal surfaces 19 and 20 of heads 2 and 3. When the stack has cleared welding heads 2 and 3, they are moved into the fusing position as shown in step 3 of FIG. 1. Fusing sections 15 and 16 of tapes 11 and 12 are now held between heads 2 and 3. Thereafter, as shown in Step 4, unit 5 is advanced toward anvil 6 and heating coil 9 is energized. Fusing section 15 is carried thereby against fusing section 16 and the two are fused together between lower connecting part 17 and upper connecting part 18.

At the same time, severing point 8 pierces fusing sections 15 and 16 and then retracts to the position shown in step 5. Anvil 6 moves toward unit 5 and removes fusing sections 15 and 16. The tapes are now divided into upper lengths 11 and 12 and lower lengths 13 and 14. The latter are bound tightly around the stack while the former are connected at fuse point 21. Tapes 13 and 14 are joined at fuse point 22 and thereby bind the stack. Heads 2 and 3 then return to their withdrawn position and the device is ready for the next stack.

Although only a limited number of specific embodiments of the present Invention have been expressly disclosed, it is, nonetheless, to be broadly construed and not to be limited except by the character of the claims appended hereto.

What we claim is:

1. A device for binding a stack of generally planar elements comprising a first source of flexible elongated tape and a second source of said tape, said first source being on one side of a path through which said stack travels, and said second source being on an opposite side of said path, first and second welding heads movable in a direction perpendicular to said path between an open position, spaced apart from each other, and a fusing position, adjacent each other, said heads having proximal surfaces facing each other, at least one of said heads comprising a heater adapted to fuse said tape, said tape extending from said first source and said second source, surrounding said stack on three exterior faces thereof, and in contact with said surfaces when said heads are in open position, said heads adapted to thereafter move to said fusing position, thereby dividing said tape into a first portion, fused around said stack, and a second portion extending from said first source and said second source and fused together at said surfaces.

2. The device of claim 1 wherein said tape from said first source and said tape from said second source are biased in a direction away from said surfaces.

3. The device of claim 1 wherein said first source and said second source are reels holding said tape.

4. The device of claim 1 wherein said first head has a protuberance on its surface to sever said tape when in said fusing position.

5. The device of claim 1 wherein said second head has an end face to remove said tape between said first portion and said second portion.

6. A method of binding a stack of generally planar elements comprising providing flexible elongated tape from sources on both sides of a path, whereby said tape extends across said path, passing said stack through said path in a downstream direction past a pair of welding heads, said heads being on either side of said path, whereby said tape surrounds said stack on its downstream face and two sides substantially perpendicular thereto, and is in contact with proximal surfaces of said welding heads, moving said heads in a fusing direction perpendicular to said path substantially parallel to said downstream face so that said proximal surfaces contact each other with fusing sections of said tape therebetween, fusing said sections together to both strap said stack and provide said tape across said path for a succeeding stack of said elements.

7. The method of claim 6 wherein said sources exert tension on said tape in directions away from said proximal surfaces.

8. The method of claim 6 wherein said fusing sections are severed to separate said tape which surrounds said stack from said tape which extends across said path for said succeeding stack.

9. A device for forming and compressing an initial stack of generally planar elements in a direction perpendicular to said elements comprising a receiver for a plurality of said elements deposited successively thereon to form said initial stack, said receiver adapted for transfer of said initial stack along a path in a downstream direction to a compressor by moving laterally out of said path, a retainer thereafter introduced into said path upstream of said initial stack, said compressor adapted to move toward said retainer, thereby compressing said initial stack.

10. The device of claim 9 wherein, after said transfer, said receiver returns to said path to receive a further plurality of said elements to form a successive stack and thereafter transfer said successive stack to said compressor for compression between said retainer and said compressor.

11. The device of claim 10 wherein said transfer and said compression are repeat ed a plurality of times.

12. The device of claim 9 wherein said compressor is adapted to discharge said initial stack after said compressing.

13. A method of forming and compressing an initial stack of generally planar elements in a direction perpendicular to said elements comprising building said stack by successive deposits of said elements on a receiver, transfer of said stack from said receiver to a compressor in a downstream path, introduction of a retainer into said path upstream of said stack on said compressor, moving said compressor toward said retainer to compress said stack therebetween.

14. The device of claim 9 wherein, prior to said transfer, at least one finger compresses a fold edge of said elements.

15. The method of claim 13 wherein said receiver moves laterally out of said path to effect said transfer.

16. The method of claim 15 wherein said receiver returns to said path to receive further said elements to build a successive stack, thereafter said successive stack is transferred to said compressor for compression between said compressor and said retainer.

17. The method of claim 16 wherein said transfer and compression are carried out a plurality of times.

18. The method of claim 13 wherein said compressor discharges said stack after compressing.

19. The method of claim 13 further comprising binding said stack after said compression by providing flexible elongated tape from sources on both sides of a path, whereby said tape extends across said path, passing said stack through said path in a downstream direction past a pair of welding heads, said heads being on either side of said path, whereby said tape surrounds said stack on its downstream face and two sides substantially perpendicular thereto, and is in contact with proximal surfaces of said welding heads, moving said heads in a fusing direction perpendicular to said path substantially parallel to said downstream face so that said proximal surfaces contact each other with fusing sections of said tape therebetween, fusing said sections together to both strap said stack and provide said tape across said path for a succeeding stack of said elements.

20. The device of claim 9 further comprising a first source of flexible elongated tape and a second source of said tape, said first source being on one side of a path through which said stack travels, and said second source being on an opposite side of said path, first and second welding heads movable in a direction perpendicular to said path between an open position, spaced apart from each other, and a fusing position, adjacent each other, said heads having proximal surfaces facing each other, at least one of said heads comprising a heater adapted to fuse said tape, said tape extending from said first source and said second source, surrounding said stack on three exterior faces thereof, and in contact with said surfaces when said heads are in open position, said heads adapted to thereafter move to said fusing position, thereby dividing said tape into a first portion, fused around said stack, and a second portion extending from said first source and said second source and fused together at said surfaces.

21. A device for building a series of bundles of generally planar elements, said series comprising an initial stack and at least one successive stack, said device comprising a gripper conveyor having a plurality of grippers mounted thereon and moving in a downstream direction, each of said grippers adapted to releasably hold one of said elements, a belt conveyor adjacent said gripper conveyor, and moving in said downstream direction, said belt conveyor adapted to receive said elements released by said grippers, said belt conveyor urging said elements toward a receiver therefor, thereby forming said initial stack, a separator, reciprocally movable between an operative position, in a space adjacent said initial stack and said gripper conveyor, and a withdrawn position, outside said space, said separator in said withdrawn position while said initial stack is building, said separator in said operative position to begin building said successive stack, said grippers adapted to release said elements at a first point while said stack is building, said grippers adapted to release said elements at a second point, downstream of said first point, as said separator moves from said withdrawn position to said operative position.

22. The device of claim 21 wherein, after said separator has moved from said withdrawn position to said operative position, said grippers release said elements at said first point.

23. The device of claim 21 comprising a first source of flexible elongated tape and a second source of said tape, said first source being on one side of a path through which said stack travels, and said second source being on an opposite side of said path, first and second welding heads movable in a direction perpendicular to said path between an open position, spaced apart from each other, and a fusing position, adjacent each other, said heads having proximal surfaces facing each other, at least one of said heads comprising a heater adapted to fuse said tape, said tape extending from said first source and said second source, surrounding said stack on three exterior faces thereof, and in contact with said surfaces when said heads are in open position, said heads adapted to thereafter move to said fusing position, thereby dividing said tape into a first portion, fused around said stack, and a second portion extending from said first source and said second source and fused together at said surfaces.

24. The device of claim 20 wherein, after said transfer, said receiver returns to said path to receive a further plurality of said elements to form a successive stack and thereafter transfer said successive stack to said compressor for compression between said retainer and said compressor.

25. A method of building a series of bundles of generally planar elements, said series comprising an initial stack and at least one successive stack, said method comprising transfer of each of said elements from a supply thereof to an initial conveyor, said initial conveyor serially releasing said elements at a first point onto a belt conveyor, said belt conveyor urging said elements toward a receiver therefor, thereby forming said initial stack, movement of a separator into a space between said belt conveyor and said first point as said initial stack is completed and said successive stack is begun, during said movement of said separator, said elements are released by said first conveyor at a second point downstream of said first point, thereby providing sufficient time for said separator to enter said space.

26. The method of claim 25 further comprising binding said initial stack by providing flexible elongated tape from sources on both sides of a path, whereby said tape extends across said path, passing said stack through said path in a downstream direction past a pair of welding heads, said heads being on either side of said path, whereby said tape surrounds said stack on its downstream face and two sides substantially perpendicular thereto, and is in contact with proximal surfaces of said welding heads, moving said heads in a fusing direction perpendicular to said path substantially parallel to said downstream face so that said proximal surfaces contact each other with fusing sections of said tape therebetween, fusing said sections together to both strap said stack and provide said tape across said path for a succeeding stack of said elements.

27. The device of claim 9 comprising a transfer wheel, rotatable about its axis, a plurality of grippers mounted on said wheel, said grippers having closed positions, wherein said elements are gripped, and open positions, wherein said elements are not gripped, said grippers adapted to move from said closed positions to said open positions at a release point adjacent said receiver, whereby said elements are deposited onto said receiver.

28. The device of claim 27 wherein, after said transfer, said receiver returns to said path to receive a further plurality of said elements to form a successive stack and thereafter transfer said successive stack to said compressor for compression between said retainer and said compressor.

29. The device of claim 28 wherein said compression is repeated at least one time.

30. The device of claim 27 wherein said compressor is adapted to discharge said initial stack after said compressing.

31. A transfer device for successively feeding a plurality of generally planar elements to a stacking fork, said transfer device comprising a transfer wheel, rotatable about its axis, a plurality of grippers mounted on said wheel, said grippers having closed positions, wherein said elements are gripped by said grippers, and open positions, wherein said elements are not gripped by said grippers, said grippers adapted to move from said closed positions to said open positions at a release point adjacent said stacking fork, whereby each of said elements is individually in contact with said stacking fork or a previously deposited planar element on said fork before being released by said transfer device.

* * * * *